US010357673B2

(12) United States Patent
Scheffer

(10) Patent No.: US 10,357,673 B2
(45) Date of Patent: Jul. 23, 2019

(54) FIRE PUMP CONTROLLER CONFIGURED TO CONTROL PRESSURE MAINTENANCE IN SPRINKLER SYSTEMS

(71) Applicant: ASCO Power Technologies L.P., Florham Park, NJ (US)

(72) Inventor: Daniel G. Scheffer, Boonton, NJ (US)

(73) Assignee: ASCO Power Technologies L.P., Florham Park, NJ (US)

( * ) Notice: Subject to any disclaimer, the term of this patent is extended or adjusted under 35 U.S.C. 154(b) by 1 day.

(21) Appl. No.: 15/630,447

(22) Filed: Jun. 22, 2017

(65) Prior Publication Data

US 2018/0008850 A1 Jan. 11, 2018

Related U.S. Application Data

(63) Continuation of application No. 14/204,995, filed on Mar. 11, 2014.

(60) Provisional application No. 61/780,879, filed on Mar. 13, 2013.

(51) Int. Cl.

| | |
|---|---|
| ***A62C 35/68*** | (2006.01) |
| ***F04D 15/00*** | (2006.01) |
| ***F04B 23/04*** | (2006.01) |
| ***F04B 49/02*** | (2006.01) |
| ***F04B 49/06*** | (2006.01) |
| *A62C 37/00* | (2006.01) |

(52) U.S. Cl.

CPC ..... *A62C 35/68* (2013.01); *F04B 23/04* (2013.01); *F04B 49/02* (2013.01); *F04B 49/06* (2013.01); *F04B 49/065* (2013.01); *F04D 15/00* (2013.01); *A62C 37/00* (2013.01)

(58) Field of Classification Search

CPC ..... A62C 35/68; A62C 37/00; F04B 49/065; F04B 49/06; F04B 49/02; F04B 23/04; F04D 15/00; G05D 7/06; G05D 7/0676

USPC ..... 417/426, 4, 5; 700/282, 301

See application file for complete search history.

(56) References Cited

U.S. PATENT DOCUMENTS

2005/0222287 A1* 10/2005 Roberts ..... A62C 5/02 521/131

2010/0138054 A1* 6/2010 Goupil ..... A62C 35/68 700/282

* cited by examiner

*Primary Examiner* — Essama Omgba
*Assistant Examiner* — Stephen A Mick
(74) *Attorney, Agent, or Firm* — Locke Lord LLP

(57) ABSTRACT

Example devices, systems, and methods disclosed herein relate to a controller configured to control pressure maintenance in a fire protection system. A controller may be configured to control a fire pump to provide a first level of water pressure and to control operation of a jockey pump that is coupled in parallel with the fire pump to provide a second level of water pressure that is less than the first level. The controller is further configured to receive, from a pressure sensor coupled to the fire protection system, an output representative of the water pressure. The controller is configured to provide instructions to initiate the jockey pump based on a pressure value associated with the output being below a first value, and to provide instructions to initiate the fire pump based on the pressure value being below a second value that is less than the first value.

15 Claims, 6 Drawing Sheets

FIRE PUMP CONTROLLER CONFIGURED TO CONTROL PRESSURE MAINTENANCE IN SPRINKLER SYSTEMS

CROSS REFERENCE TO RELATED APPLICATIONS

The present application is a continuation of U.S. patent application Ser. No. 14/204,995 filed Mar. 11, 2014, which claims priority to U.S. Provisional Patent Application No. 61/780,879 filed Mar. 13, 2013, the entire contents of which are incorporated entirely herein by reference.

BACKGROUND

A fire protection system may comprise a sprinkler system and/or a standpipe system. A sprinkler system is an active fire protection measure that provides adequate pressure and flow to a water distribution piping system, onto which a plurality of fire sprinklers is connected. Each closed-head sprinkler can be triggered once an ambient temperature around the sprinkler reaches a design activation temperature of the individual sprinkler head. In a standard wet-pipe sprinkler system, each sprinkler activates independently when the predetermined heat level is reached. Because of this, the number of sprinklers that operate is limited to only those near the fire, thereby maximizing the available water pressure over the point of fire origin.

A standpipe system is another type of fire protection measure consisting of a network of vertical piping installed in strategic locations within a multi-story building. The vertical piping may deliver large volumes of water to any floor of the building to supply hose lines of firefighters, for example.

FIG. 1 illustrates a block diagram of a prior art fire protection installation 50. A fire pump 52 boosts water pressure of a water source 54 by transferring energy to the water. The increase in water pressure acts to move the water into a fire protection system 56. A fire pump controller 58 serves to automatically govern, in some predetermined manner, the starting and stopping of the fire pump 52 and to monitor and signal the status and condition of the fire pump 52 (consisting of a pump and a driver), the fire pump controller 58, and accessories. A pressure maintenance pump or jockey pump 60 serves to maintain the pressure on the fire protection system 56 between preset limits when the fire pump 52 is not flowing water. A pressure maintenance pump controller (or jockey pump controller) 62 serves to automatically govern, in some pre-determined manner, the starting and stopping of the jockey pump 60 and to monitor and signal the status and condition of the jockey pump 60 (consisting of a pump and a driver) and the jockey pump controller 62. Check valves, such as check valve 64, are used in the fire pump installation 50 to allow the flow of water in one direction only for the purpose of building pressure in the fire protection system 56. Check valves are installed between the outlets of each of the pumps and the fire protection system 56. Gate valves, such as gate value 66, are installed on the inlets and outlets of each of the pumps and are used to isolate either of the two pumps from the fire protection system 56 for maintenance purposes.

The output of the jockey pump 60 is connected to the system side of the check valve in a typical fire pump installation. The main function of the jockey pump 60 is to maintain system water pressure by automatically cycling between pressure set points. That is, the jockey pump 60 will maintain water pressure in the fire protection system 56 by automatically cycling on and off between predetermined, independent START and STOP pressure settings. In this way, the jockey pump 60 functions to make up for small leaks in the system and thereby helps to prevent the larger fire pump from nuisance cycling. Ordinarily, then, the START and STOP settings of the jockey pump 60 are set well above those of the fire pump 52 so that the jockey is cycling to maintain pressure against normal leaks.

The fire pump installation 50 includes the fire pump 52 connected to the water source 54 by way of the gate valve 66. The water source 54 provides water flow at a pressure to sprinkler system risers and hose standpipes. Generally, fire pumps are needed when the water supply cannot provide sufficient pressure to meet hydraulic design requirements of the fire sprinkler system. This usually occurs in a building that is tall, such as in high-rise buildings, or in systems that require a relatively high terminal pressure at the fire sprinkler to provide a large volume of water, such as in storage warehouses.

The fire pump 52 starts when a pressure in the fire protection system 56 drops below a certain predetermined start pressure (low pressure). The pressure in the fire protection system 56 may drop significantly when one or more fire sprinklers are exposed to heat above their design temperature, and opens, releasing water. Alternately, fire hose connections to standpipe systems may be opened by firefighters causing a pressure drop in the fire protection system 56. The fire pump 52 may have a rating between 3 and 3500 horsepower (HP).

The jockey pump 60 is intended to maintain pressure in the fire protection system 56 so that the larger fire pump 52 does not need to constantly run. For example, the jockey pump 60 maintains pressure to an artificial level so that the operation of a single fire sprinkler will cause a pressure drop that will be sensed by the fire pump controller 58, causing the fire pump 52 to start. The jockey pump 60 may have a rating between ¼ and 100 horsepower (HP).

The jockey pump 60 may maintain pressure above the pressure settings of the larger fire pump 52, so as to prevent the main fire pump 52 from starting intermittently. For example, the jockey pump 60 provides makeup water pressure for normal leakage within the system (such as packing on valves, seepage at joints, leaks at fire hydrants, or leakage within the system such as backward flow through check valves 64, from the system 58 toward the lower pressure source 54), and inadvertent use of water from the water supply. When the fire pump 52 starts, a signal may be sent to an alarm system of the building to trigger the fire alarm. Nuisance operation of the fire pump 52 eventually causes fire department intervention. Nuisance operation of the fire pump 52 also increases wear on the main fire pump 52. Thus, it is generally desired to either reduce and/or avoid any nuisance or unintended operation of the fire pump 52.

In the United States, the application of the jockey pump 60 in a fire protection system is provided by NFPA 20: Standard for the Installation of Stationary Pumps for Fire Protection, which prohibits a main fire pump or secondary fire pump from being used as a pressure maintenance pump.

Each of the fire pump 52 and the jockey pump 60 include pump controllers, which may comprise a microprocessor-based controller that can be used to adjust start and stop set points.

As just one example, as early as January 2001, microprocessor-based jockey pump controllers were provided by Firetrol, Inc. of Cary, N.C. These microprocessor-based pump controllers or jockey pump controllers were typically housed in an industrial enclosure, included a digital display and received pressure information by way of a solid state pressure sensor, typically via 1-5 Vdc. Using the electronic pressure monitors, water pressure can be measured with a pressure transducer providing an output of 1-5 Vdc for ranges of 0-300 and 0-600 psi. Operation of the pumps could be controlled via programmable set points. Such set points for each pump include start and stop pressures, and on-delay, minimum run, and off-delay timers. An additional output is provided for a call to start indicating a low pressure condition, and a remote stop/reset input is provided for reset of all timing functions.

The jockey pump controller 62 may have a start pressure set point of approximately five to ten pounds per square inch greater than the start pressure set point in the fire pump controller 58. In this manner, the jockey pump controller 62 cycles the jockey pump 60 to maintain the system at a predetermined pressure well above the start setting of fire pump 52 so that the fire pump only runs when a fire occurs or the jockey pump 60 is overcome by a larger than normal loss in system pressure.

SUMMARY

In one example aspect, a fire pump control system is provided that comprises a controller configured to control operation of a fire pump so as to provide a first level of water pressure in a fire protection system and to control operation of a jockey pump that is coupled in parallel with the fire pump so as to provide a second level of water pressure in the fire protection system[SD1]. The controller is further configured to receive, from a pressure sensor coupled to the fire protection system, an output representative of the water pressure in the fire protection system. The controller is further configured to provide instructions to initiate the jockey pump based on a pressure value associated with the output being below a first value, and provide instructions to initiate the fire pump based on the pressure value associated with the output being below a second value, wherein the second value is less than the first value.

In another example aspect, a method performed by a controller that is configured to control operation of both a fire pump and a jockey pump in a fire protection system is provided. The method comprises receiving, from a pressure sensor coupled to a fire protection system, an output representative of water pressure in the fire protection system. The method also comprises providing instructions to initiate a jockey pump based on a pressure value associated with the output being below a first value. The jockey pump is configured to provide a first level of water pressure in the fire protection system. The method also comprises providing instructions to initiate a fire pump based on the pressure value associated with the output being below a second value, and the second value is less than the first value. The fire pump is coupled in parallel with the jockey pump and is configured to provide a second level of water pressure in the fire protection system that is more than the first level of water pressure.

In another example aspect, a non-transitory computer-readable medium is provided that has stored therein instructions, that when executed by a controller that is configured to control operation of both a fire pump and a jockey pump in a fire protection system, cause the controller to perform functions. The functions comprise receiving, from a pressure sensor coupled to a fire protection system, an output representative of water pressure in the fire protection system. The functions also comprise providing instructions to initiate a jockey pump based on a pressure value associated with the output being below a first value. The jockey pump is configured to provide a first level of water pressure in the fire protection system. The functions also comprise providing instructions to initiate a fire pump based on the pressure value associated with the output being below a second value, and the second value is less than the first value. The fire pump is coupled in parallel with the jockey pump and is configured to provide a higher capacity of water flow to the sprinkler system.

The foregoing summary is illustrative only and is not intended to be in any way limiting. In addition to the illustrative aspects, embodiments, and features described above, further aspects, embodiments, and features will become apparent by reference to the figures and the following detailed description.

DETAILED DESCRIPTION

Figure 1:
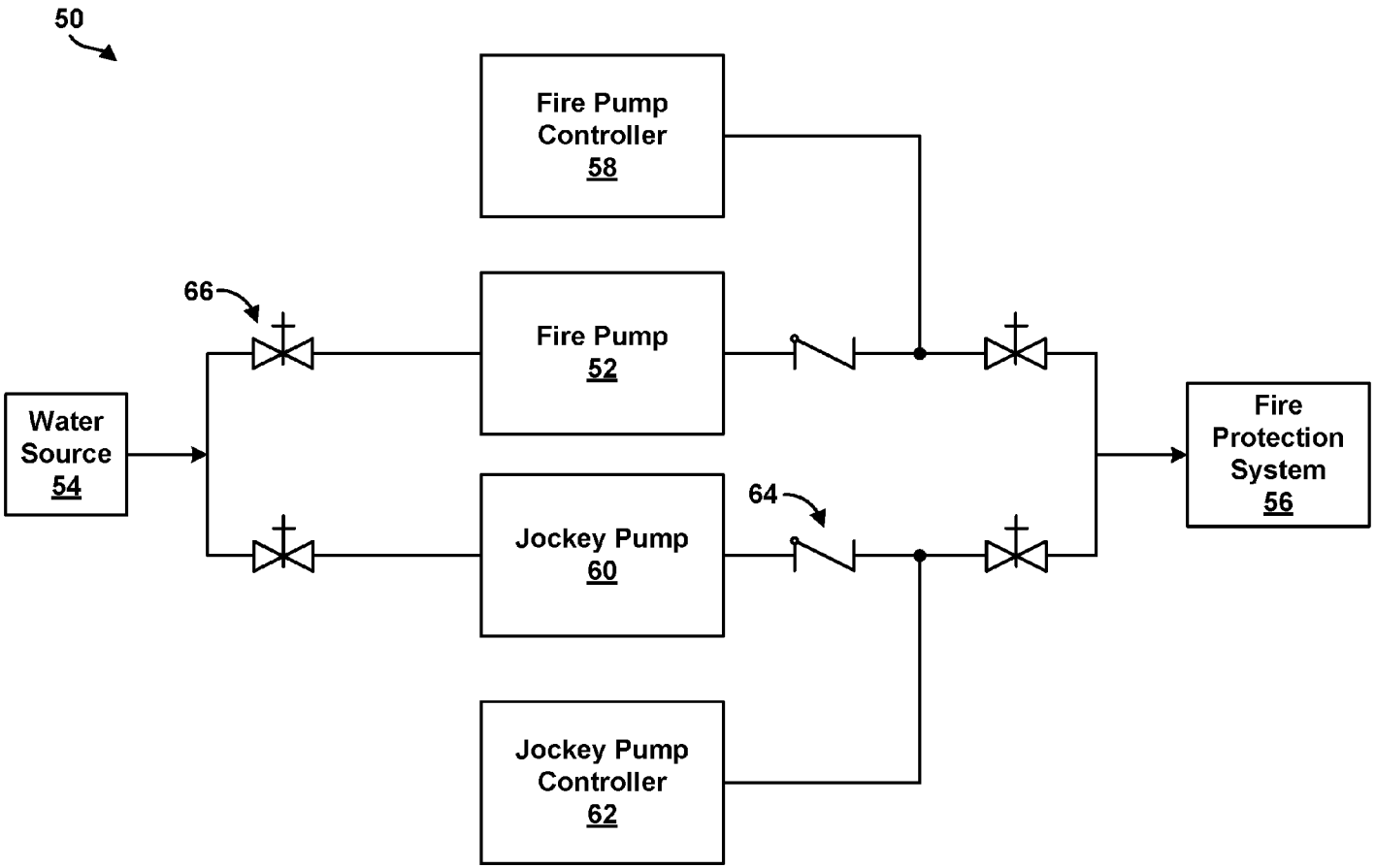
FIG. 1 Prior Art
FIG. 1 illustrates a block diagram of a prior art fire protection installation.

In the following detailed description, reference is made to the accompanying drawings, which form a part hereof In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the figures, can be arranged, substituted, combined, separated, and designed in a wide variety of different configurations, all of which are explicitly contemplated herein.

Example devices, systems, and methods disclosed herein relate to a controller configured to control pressure maintenance in a fire protection system. A single controller may be configured to control a fire pump to provide a first level of water pressure and to control a jockey pump that is coupled in parallel with the fire pump to provide a second level of water pressure. The controller is further configured to receive, from a pressure sensor coupled to the fire protection system, an output representative of the water pressure. The controller is configured to provide instructions to initiate the jockey pump based on a pressure value associated with the output being below a first value, and to provide instructions to initiate the fire pump based on the pressure value being below a second value that is less than the first value.

Figure 2:
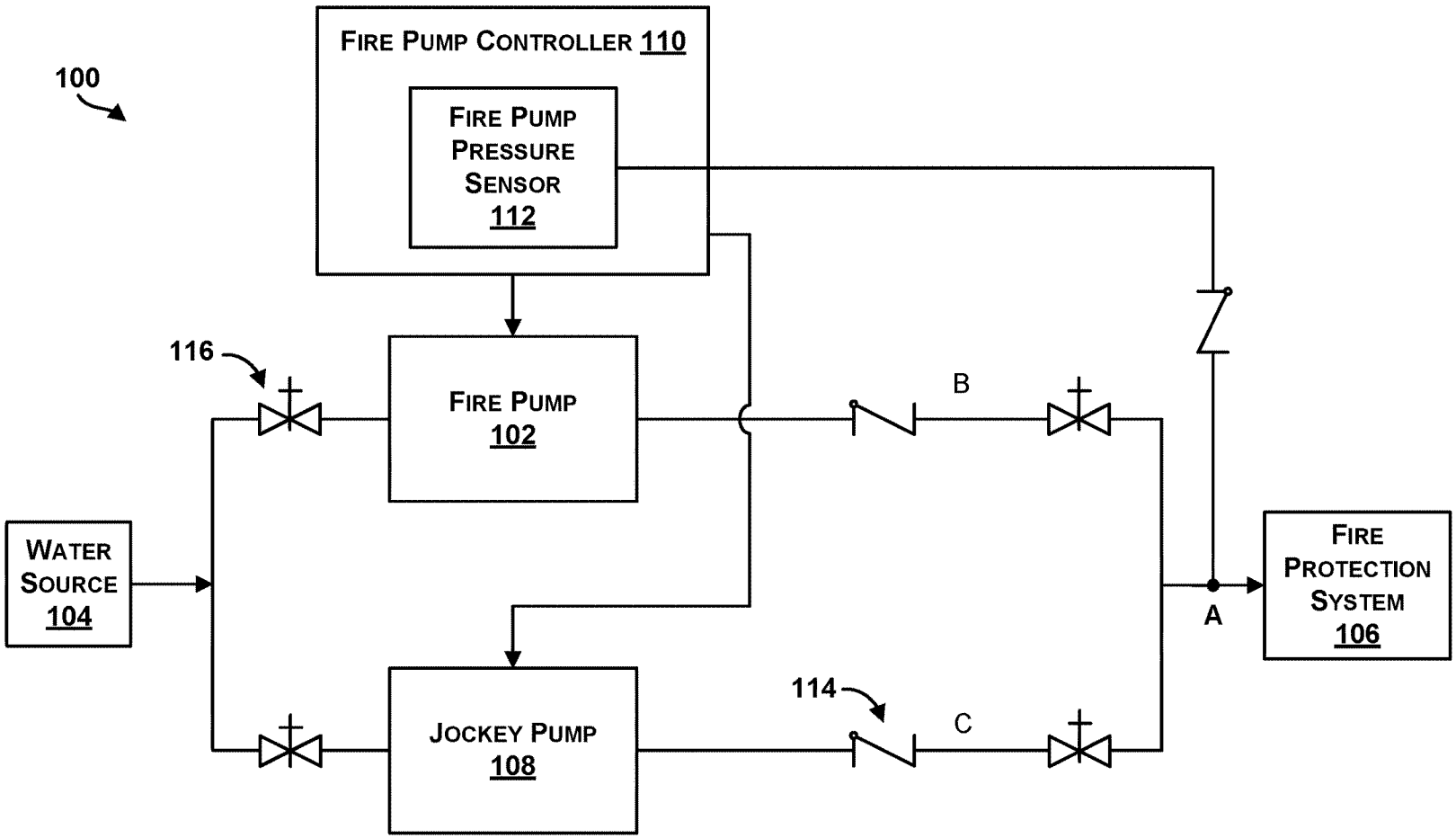
FIG. 2 illustrates a block diagram of an example fire pump installation.

Referring now to the figures, FIG. 2 illustrates a block diagram of an example fire pump installation 100. The fire pump installation 100 includes a fire pump 102 that is connected to a water source 104. The water source 104 provides water flow at a high pressure to a fire protection system 106. The fire pump 102 may be configured to provide water flow at a higher flow rate to the fire protection system 106. The fire pump 102 may be powered by a number of components, including one or more of an electric motor, diesel engine, or a steam turbine. In some instances, the electrical motor may be powered using an emergency generator. In one example, the system may include multiple fire pumps (not shown).

In some examples, the fire pump 102 may be needed when the water source 104 cannot provide sufficient pressure to meet hydraulic design requirements of the fire protection system 106. For instance, this may occur in a building that is tall, such as a high-rise building, or in a building that requires a relatively high terminal pressure in the fire protection system 106 to provide a large volume of water, such as a storage warehouse.

The fire pump installation 100 may also include a jockey pump 108 that may be configured to maintain pressure in the fire protection system 106 so that the fire pump 102 does not need to constantly run. For example, the jockey pump 108 may maintain pressure at an artificially high level so that the operation of a single fire sprinkler will cause a pressure drop that will be sensed by a fire pump controller 110, causing the fire pump 102 to start. In some examples, the jockey pump 108 may be smaller than the fire pump 102. For example, the jockey pump 108 may be of an appropriate size in order to make up for pressure lost due to a leakage in the fire protection system 106 within a predetermined time frame (e.g., 10 minutes).

The fire pump controller 110 may be an electric fire pump controller, a diesel fire pump controller, a full voltage starting fire pump controller, a wye-delta fire pump controller, among other types. Devices within the fire pump controller 110 may perform functions such as receiving signals from devices (e.g., pressure sensors, sprinkler alarm valves, or remote fire alarm equipment), and activating motor control devices to provide power to motors driving the fire pump 102. Additionally, the fire pump controller 110 may monitor operation and performance of the fire pump 102. Optionally, the fire pump controller 102 may also monitor a three-phase power line to determine information associated with the three-phase power line.

In one example, the fire pump controller 110 may receive a pressure signal from the fire pump pressure sensor 112. The fire pump pressure sensor 112 may be any type of pressure sensor or transducer, or solid state pressure sensor. For instance, the fire pump pressure sensor 112 may be any type of pressure sensor which may generate a signal as a function of an imposed pressure.

As shown in FIG. 2, the fire pump controller 110 may be configured to control operation of the fire pump 102, and may also be coupled to the jockey pump 108 to control operation of the jockey pump 108. The fire pump 102 and the jockey pump 108 may be coupled in parallel to the water source 104 and the fire protection system 106.

In the existing art, a jockey pump is controlled by an independent pressure sensor or pressure switch and controller (see FIG. 1). Using examples herein, a single pressure sensor 112 and fire pump controller 110 is configured to control both the fire pump 102 and the jockey pump 108.

In some examples, the fire pump 102 and the jockey pump 108 are not configured as redundant pumps for fire protection. Rather, the jockey pump 108 may be configured to save wear on the fire pump 102 during nuisance starts, and may not have capacity to pump enough water to back up the fire pump 102.

The fire pump controller 110 may be configured to initiate operation of the fire pump 102 when a pressure in the fire protection system 106 drops below a certain predetermined start pressure. For example, the pressure in the fire protection system 106 may drop significantly when one or more fire sprinklers are exposed to heat above their design temperature, and open, releasing water. Alternately, fire hose connections to standpipe systems may be opened by firefighters causing a pressure drop in the fire protection system 106. In one instance, the fire pump 102 may have a rating between 3 and 3500 horsepower (HP).

The fire pump controller 110 may also be configured to initiate operation of the jockey pump 108 when a pressure in the fire protection system 106 drops below another certain predetermined start pressure. The jockey pump 108 may be considered a pressure maintenance pump that maintains pressure in the fire protection system 106 so that the fire pump 102 does not need to constantly run. For example, the jockey pump 106 maintains pressure to an artificially high level so that the operation of a single fire sprinkler will cause a pressure drop that will be sensed by a fire pump controller 110, causing the fire pump 102 to start. In some examples, the jockey pump 108 may have a rating between ¼ and 100 HP. Thus, the jockey pump 108 may be lower in capacity than the fire pump 102, and is capable of compensating for pressure leakage. The jockey pump 108 may not be capable to pump enough water to feed the fire protection system 106, in some examples.

In one example, the jockey pump 108 may provide makeup water pressure for normal leakage within the system (such as packing on valves, seepage at joints, leaks at fire hydrants, and backwards through check valves) and inadvertent use of water from the water source 104. When the fire pump 102 starts, a signal may be sent to an alarm system of a building to trigger a fire alarm. Nuisance operation of the fire pump 102 may eventually cause fire department intervention and increase wear on the fire pump 102. Thus, it is generally desired to either reduce and/or avoid any nuisance or unintended operation of the fire pump 102.

The fire pump controller 110 may comprise a microprocessor-based controller that can be used to adjust start and stop set points. For example, the fire pump controller 110 may automatically cause the fire pump 102 to start or the jockey pump 108 to start when a water pressure is below a pressure set point. The jockey pump 108 may have a start pressure set point of approximately five to ten pounds per square inch (psi) greater than the start pressure point of the fire pump controller 110. In this manner, the fire pump controller 110 cycles the jockey pump to maintain the fire protection system 106 at a predetermined pressure well above the start setting of the fire pump 102 so that the fire pump 102 only runs when a fire occurs or the jockey pump 108 is overcome by a larger than normal loss in system pressure.

The fire pump controller 110 may optionally include a switch to allow automatic or manual operation of the fire pump 102 and/or the jockey pump 108. Additionally, the fire pump controller 110 may include a minimum run timer to prevent short cycling of the fire pump 102 and/or the jockey pump 108. In some examples, the fire pump controller 110 may further include an emergency manual run mechanism to mechanically close motor contactor contacts in an emergency condition.

The fire installation system 100 also includes check valves 114 and gate valves 116. The check valves 114 are used in the fire pump installation 100 to allow the flow of water in one direction only for the purpose of building pressure in the fire protection system 106. Check valves 114 are installed between the outlets of each of the fire pump 102 and jockey pump 108, and the fire protection system 106. The gate valves 116 are installed on the inlets and outlets of each of the fire pump 102 and jockey pump 108 and are used to isolate either the fire pump 102 or jockey pump 108 from the fire protection system 106 and water source 104 for maintenance or other purposes.

As shown in FIG. 2, when the gate valves 114 are open, the fire pump pressure sensor 112 monitors water pressure in the fire protection system 106 at an input (point A) to the fire protection system 106, and thus, can measure water pressure within a sensing line of both the fire pump 102 and the jockey pump 108. Since in normal operation the gate valves are open (they are only closed for maintenance) the pressure is approximately the same at points A, B, and C. So the pressure sensing line may also be connected to point B, or C, or through valves could be configured to be connected to both B and C. By controlling valves in the pressure sensing lines, one can maintain or test the fire pump system, or the jockey pump system separately. One could also install a pressure sensing line at point B, and at C, and install two pressure sensors (one for each sensing line) in the controller. One sensor to control the jockey pump, and one to control the fire pump. Both sensors would be connected to the one controller that is used to control both the jockey pump and the fire pump.

In one example, the fire pump controller 110 may be coupled to the fire pump 102 and to the jockey pump 108 via a communication link that may be wired or wireless. For example, the communication link may include a serial Modbus communication link, a two-wire RS-485 link, a half-duplex or full-duplex parallel communication link, or any type of wired or wireless communication link facilitating communication.

The communication link may permit the exchange of one or more of pressures, pressure set points, or pump operation statuses, among other types of information between the fire pump controller 110 and the fire pump 102, and between the fire pump controller 110 and the jockey pump 108. And to monitoring or supervisory systems. Or to a computer network for purposes of automatically sending emails or other network notifications when a status changes or an alarm condition is detected.

Figure 3:
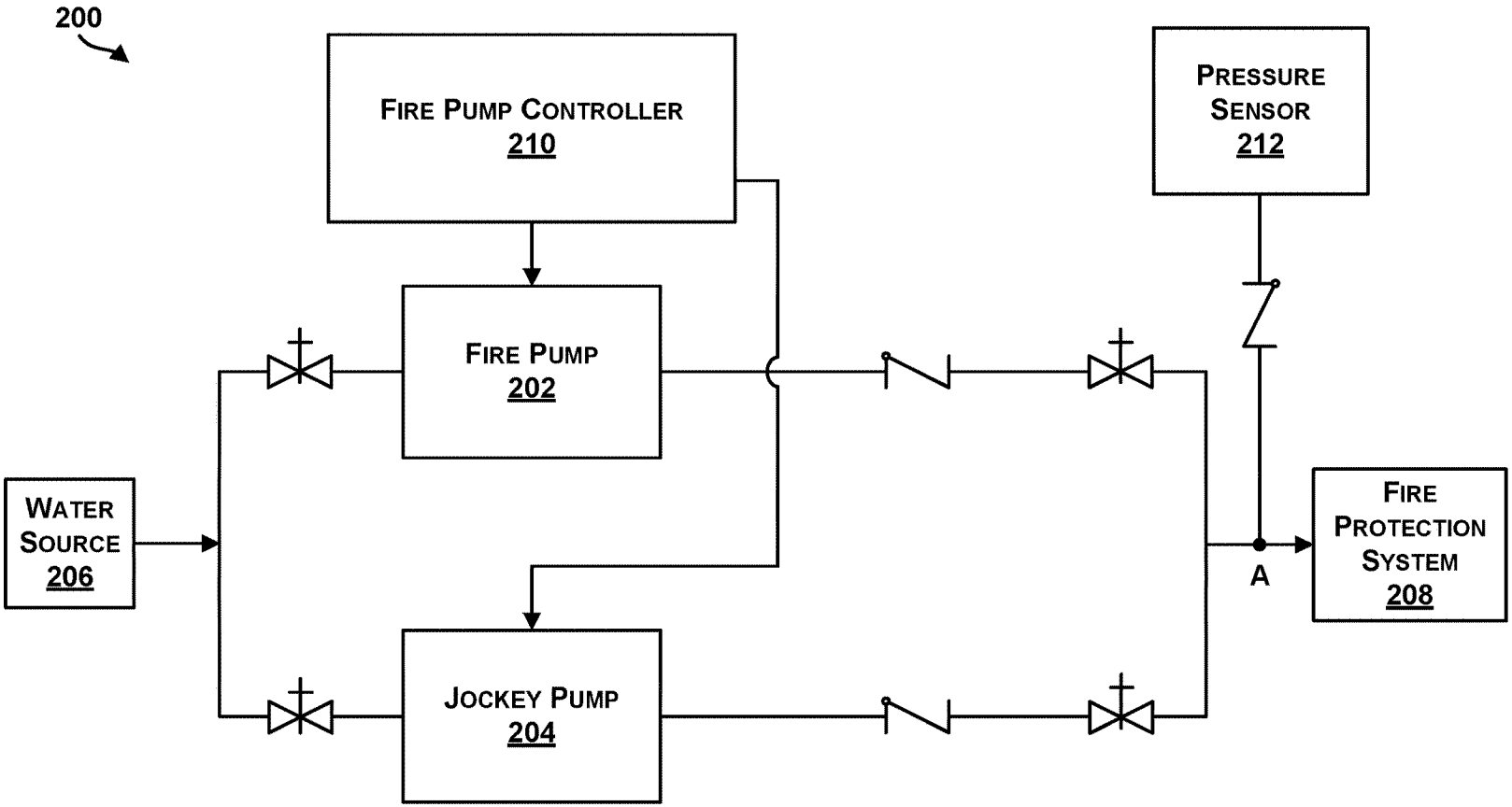
FIG. 3 illustrates a block diagram of another example fire pump installation.

FIG. 3 illustrates a block diagram of another example fire pump installation 200. The fire pump installation 200 includes a fire pump 202 and a jockey pump 204 coupled to a water source 206 to feed water to a fire protection system 208. A fire pump controller 210 is coupled to and configured to control operation of the fire pump 202 and the jockey pump 204. A pressure sensor 212 is coupled to an input of the fire protection system 208 to measure or determine a water pressure. The pressure sensor 212 may be coupled, via wired or wireless communications, to the fire pump controller 210 to provide the water pressure value to the fire pump controller 210. In turn, the fire pump controller 210 may initiate operation of the fire pump 202 and/or the jockey pump 204.

In the example shown in FIG. 3, the pressure sensor 212 may be mounted or positioned at any input of the fire protection system 208 or coupled to any valve to measure a water pressure level at a desired location. For example, the pressure sensor 212 may be connected to the fire protection system 208 on an output side of a check-valve, and the pressure sensor 212 may include or be coupled to a transceiver to wirelessly transmit the pressure value to the fire pump controller 210, for example. A pressure at this connection point of the pressure sensor 212 may be representative of a pressure in the fire protection system 208. If the pressure sensor 212 senses a drop in pressure to a low enough level, the fire pump controller 210 may be configured to start a motor or engine to drive the fire pump 202 to restore pressure to sprinkler heads, for example.

In other examples, check valves may lose water pressure due to leakage in the valves or due to leakage elsewhere in the system. The leakage is not an indication of a fire, and it is undesirable to start the fire pump 202 if the pressure due to leakage drops to the fire pump 202 starting pressure. Nuisance starts of the fire pump 202 to compensate for pressure leakage may result in false alarms, wear on motor starters, and wear on the fire pump 202 and associated motor or engine. Thus, the pressure leakage is compensated by the fire pump controller 210 initiating the jockey pump 204.

In the examples shown in FIGS. 2 and 3, there is illustrated a single fire pump controller to control operation of both a fire pump and a jockey pump (in contrast to one pressure sensor and pump controller for the fire pump and a separate pressure sensor and controller for the jockey pump). In this manner, a reduction in cost is enabled by removing extra sensors, microprocessor control circuitry, and enclosures, for example.

Figure 4:
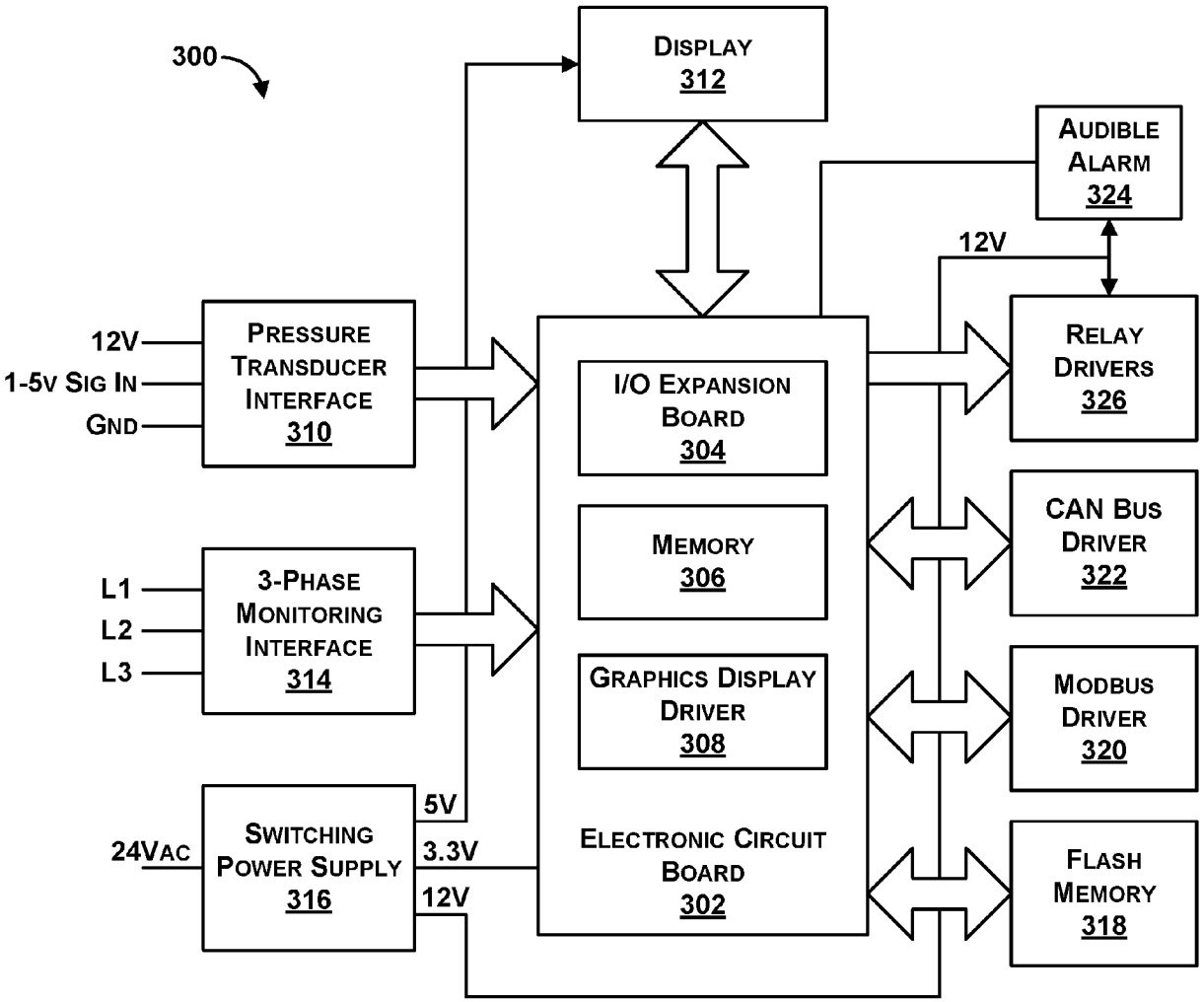
FIG. 4 is a block diagram illustrating an example pump controller configured to control a pump to maintain water pressure within a water system.

FIG. 4 is a block diagram illustrating an example pump controller 300 configured to control a pump to maintain water pressure within a water system. For example, the water system may be the fire protection system 106 of FIG. 2. In some examples, the controller 300 may include one or more functional or physical components, such as an electronic circuit board 302 and a pressure transducer interface 310. One or more of the described functional or physical components may be divided into additional functional or physical components, or combined into fewer functional or physical components. Additionally, the controller 300 may include more or less functional and/or physical components.

In some examples, the electronic circuit board 302 of the system may optionally include an input/output (I/O) expansion board 304. For instance, a ribbon cable may connect the electronic circuit board 302 to the I/O expansion board 304, and the I/O expansion board 304 may be configured to provide additional processing capabilities for the electronic circuit board 302. The electronic circuit board 302 and/or the I/O expansion board 304 may be a microprocessor, or functions of the electronic circuit board 302 and/or the I/O expansion board 304 may be performed by a microprocessor. Depending on the desired configuration, any type of microprocessor(s) may be included, including but not limited to a microprocessor, a microcontroller, a digital signal processor, or any combination thereof. The electronic circuit board 310 and/or the I/O expansion board 304 may include one or more levels of caching, a processor core, and registers. The processor core can include an arithmetic logic unit, a floating point unit, a digital signal processing core, or any combination thereof. In one example, the microprocessor comprises a TMS470-based microcontroller. In some examples, the functions of the microprocessor may be provided by multiple microprocessors.

The electronic circuit board 302 may also include a memory 306, such as for example, volatile memory (e.g., random access memory), non-volatile memory (e.g., read only memory, flash memory, etc.) or any combination thereof. The memory 306 may include stored software applications, and the electronic circuit board 302 or components of the electronic circuit board 302 may be configured to access the memory 306 and execute one or more of the software applications stored therein. Additionally, the electronic circuit board 302 may include a graphics display driver 308, utilized to drive a display 312 of the system or an external display for a PC, laptop, video monitor, television, or similar monitor device. Such displays may be provided locally at a location of the controller 300 or remotely.

The electronic circuit board 302 may receive electronic signals from the pressure transducer interface 310 indicating a pressure value, and compare the pressure value to a set point for starting or stopping a pump motor. For example, the controller 300 may be a fire pump controller controlling a motor of a fire pump or a jockey pump. In one example, the electronic circuit board 302 may output a pump run signal to energize a motor contactor coupled to the pump motor.

The pressure transducer interface 310 may be configured to receive a signal from a pressure transducer. For instance, the pressure transducer may be any type of pressure sensor which may generate a signal as a function of an imposed pressure, and provide an input to the electronic circuit board 302 via the pressure transducer interface 310. As such, the pressure transducer may be positioned in a water system to generate signals as a function of a suction pressure at the inlet of the pump, a discharge pressure at the outlet of a pump, an overall system pressure, or other water pressure. The pressure transducer may be any kind of pressure sensor that may measure any type of pressure, such as an absolute pressure, a gauge pressure, a differential pressure, or a sealed pressure, for example.

In one example, the pressure transducer may be an electronic pressure sensor using a linear variable differential transformer (LVDT) coupled to a bourdon tube. In other examples, the pressure transducer may be a solid state pressure sensing device, an electromechanical pressure sensing device, or a combination of the two. For example, the solid state pressure sensing device may comprise a semiconductor pressure transducer that includes an integrated circuit having a four resistor bridge implanted on a silicone membrane.

In some examples, the pressure transducer may include a range of 0-300 psi, 0-600 psi, or 0-1000 psi for fresh water service, sea water/foam service, or other service. Other example pressure ranges within or outside of the example pressure ranges are also possible. In one instance, the pressure transducer interface may provide an analog voltage of about 1-5 volts of direct current that can be interpreted by the pressure transducer interface 310 or the electronic circuit board 302 as indicating a corresponding water pressure between 0-600 psi.

In some instances, the pressure transducer may be included within an enclosure of the controller 300. In other instances, the pressure transducer may be mounted outside the enclosure of the system 300 and is operationally coupled to the controller 300.

The controller 300 may further include a three-phase monitoring interface 314 that may provide inputs to the electronic circuit board 302 or components of the electronic circuit board 302. For example, the three-phase monitoring interface 314 may monitor a three-phase power line for detection of phase failure or phase reversal. As an example, the electronic circuit board 302 may receive a signal(s) from the three-phase monitoring interface 314 and a microprocessor may determine whether there is a valid supply line with all three phases present, a correct phase rotation, and a proper frequency.

The electronic circuit board 302 may be powered by a switching power supply 316 that is configured to receive a 24 volt alternating current (Vac) control voltage and output appropriate voltage values to power components of the controller 300. For example, a transformer may be connected to each line of a three-phase incoming line (such as a 200-600 Vac 50/60 hertz (Hz) line), and convert the line voltage to the 24 Vac control voltage. Additionally, the power switching supply 316 may provide voltages such as 5 volts, 3.3 volts, or 12 voltages to components of the controller 300. Other voltages are also possible.

In some examples, the electronic circuit board 302 may receive or output information (such as analog and/or digital signals) from or to components of the controller 300. For example, a microprocessor may receive inputs or configuration settings via a user interface or input device. In other examples, the electronic circuit board 302 may communicate with a flash memory 318 to store operating conditions of the controller 300 or communicate using one or more of a Modbus driver 320, controller area network (CAN) bus driver 322, or other communication component. Serial network communications may take place, for example, with other systems or a local or remote computing device. Other communication interface drivers may also provide for communication using Modbus Ethernet, wired or wireless Ethernet, Bluetooth, Wi-Fi, and other similar protocol structures.

The electronic circuit board 302 or components of the electronic circuit board 302 may also output signals to an audible alarm 324 or the display 312 to provide audible or visual indications of operation of the controller 300, for example.

The electronic circuit board 302 or components of the electronic circuit board 302 may also output to relay drivers 326 for operating drivers to actuate relays. For instance, a microprocessor may output a pump run signal for operating a pump motor on the three-phase incoming line, such as by initializing the three-phase incoming line to provide power to the pump motor. In one example, the relay drivers 326 may be instructed to operate the relays until a signal is received from the electronic circuit board 302 indicating that a pressure value is satisfied and a minimum run timer has expired. The relays may include any type of switch or electrically operated switch, for example.

In some examples, a microprocessor of the electronic circuit board 302 may implement a control sequence by way of a software-based state machine. In one state machine arrangement, the state machine comprises at least three states: an Idle, a Starting State, and a Running State. For example, in the Idle State, a pump motor will not be energized and hence the pump will not be running. However, in one operational arrangement, the state machine monitors various discrete and measured data points to determine whether conditions exist to advance to a subsequent state, such as the Starting State.

During the Starting State, the control logic of the microprocessor will account for timers and/or configuration options that might be intended to delay or inhibit a state transition. The Starting State contains the logic associated with the proper startup of a pump. A successful detection of an active pump may cause the state to transition to the Running State. Failure to start the pump or pumps will likewise be detected and may result in certain alarm indications. As just one example, a failure to start alarm may be declared if a 24 Vac signal is not received from an auxiliary contact within a certain predetermined time frame (e.g., within 1 second of energizing).

In the Running State, the pump will be active. During the Running State, the state machine can monitor various discrete and measured data points to determine whether conditions exists to stop the pump and, as such, advance the control to an Idle State. During the Running State, the microprocessor based logic will also account for any timers or configuration options intended to delay or inhibit a state transition of the pump.

The controller 300 may also comprise a plurality of programmable timers. In one system arrangement, control sequence timers may be provided. The control sequence timers may interact with the pump control state machine and may comprise either an On Delay Timer or a Minimum Run Timer. The On Delay Timer can be used to guard against nuisance activations of the pump due to pressure excursions such as water hammer. The Minimum Run Timer may be used to specify a minimum length of time the pump is kept running. For example, the controller 300 can be programmed so that it can keep the pump running until the minimum run timer has expired and a STOP pressure within a fire protection system has been maintained and is therefore satisfied.

Figure 5:
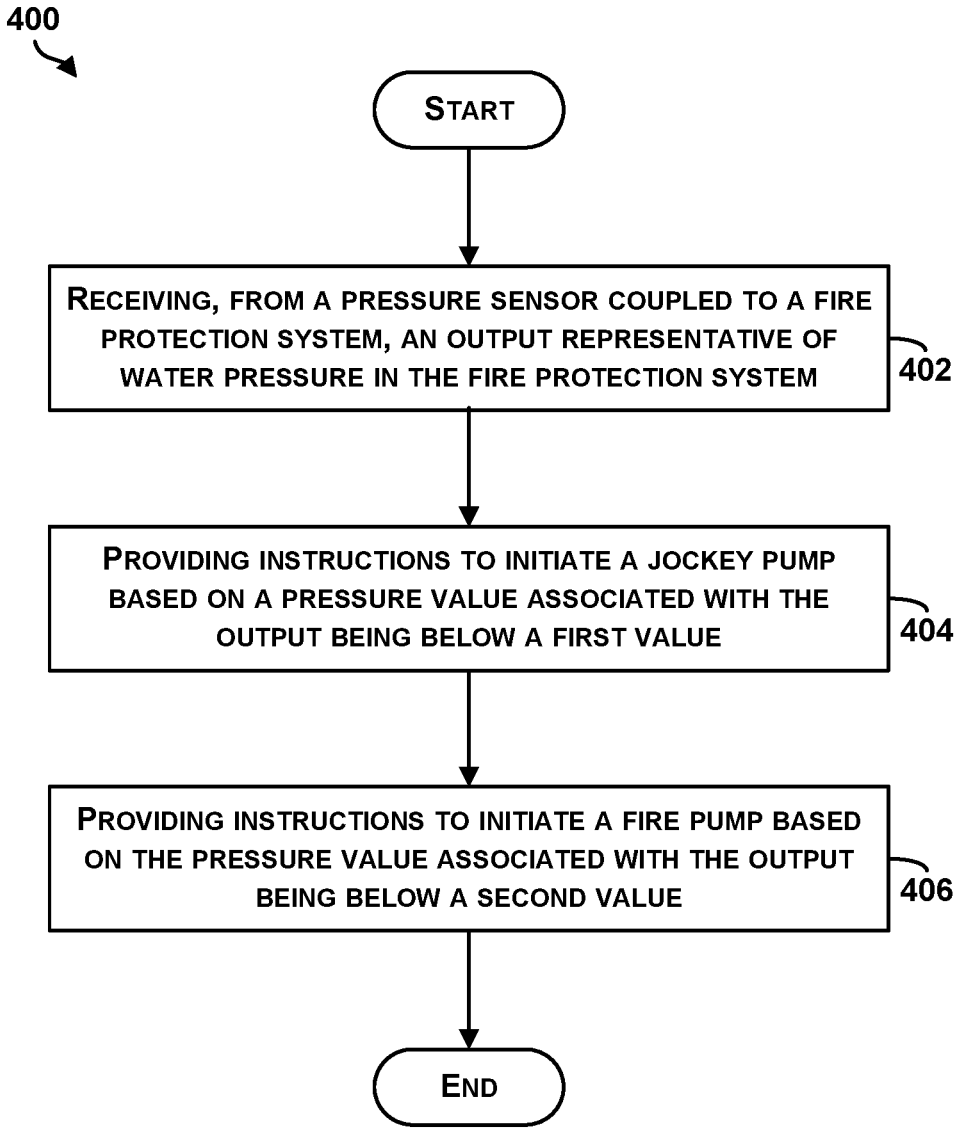
FIG. 5 is a flow chart of an example method for operating a fire pump controller.

FIG. 5 is a flow chart of an example method 400 for operating a fire pump controller. Method 400 shown in FIG. 5 presents an embodiment of a method that could be used by the fire pump controller 110 of FIG. 2, the fire pump controller 210 of FIG. 3, the controller 300 of FIG. 4, or components of any of the above, for example. It should be understood that for this and other processes and methods disclosed herein, the flowchart shows functionality and operation of one possible implementation of present embodiments. In this regard, each block may represent a module, a segment, or a portion of program code, which includes one or more instructions executable by a processor or computing device for implementing specific logical functions or steps in the process. The program code may be stored on any type of computer readable medium, for example, such as a storage device including a disk or hard drive. The computer readable medium may include non-transitory computer readable medium, for example, such as computer-readable media that stores data for short periods of time like register memory, processor cache and random access memory (RAM). The computer readable medium may also include non-transitory media, such as secondary or persistent long term storage, like read only memory (ROM), optical or magnetic disks, or compact-disc read only memory (CD-ROM), for example. The computer readable media may also be any other volatile or non-volatile storage systems. The computer readable medium may be considered a computer readable storage medium, for example, or a tangible storage device.

In addition, for the method 400 and other processes and methods disclosed herein, each block may represent circuitry that is wired to perform the specific logical functions in the process. Alternative implementations are included within the scope of the example embodiments of the present disclosure in which functions may be executed out of order from that shown or discussed, including substantially concurrent or in reverse order, depending on the functionality involved, as would be understood by those reasonably skilled in the art.

Initially, as shown at block 402, the method 400 includes receiving, from a pressure sensor coupled to a fire protection system, an output representative of water pressure in the fire protection system. The output may be received at a controller that is configured to control operation of a fire pump so as to provide a first level of water pressure in a fire protection system and to control operation of a jockey pump that is coupled in parallel with the fire pump so as to provide a second level of water pressure in the fire protection system. In some examples, the output from the pressure sensor may be received on a continuous basis or at predetermined intervals. The output may include or may indicate a magnitude of water pressure within the fire protection system (such as a sprinkler system or a standpipe system). In one example, the output may indicate the magnitude, or alternatively may indicate that the pressure is above or below a threshold level. Pressure values may be determined based on received pressure signals. For instance, an output may be a voltage between 1 and 5 volts and the voltage may correspond to a water pressure value based on a linear or non-linear relationship. In some examples, an analog-to-digital converter may be used to convert a pressure signal to a pressure value.

At block 404, the method 400 providing instructions to initiate a jockey pump based on a pressure value associated with the output being below a first value. The controller may be configured to provide the instructions to the jockey pump to cause the jockey pump to start. In some examples, the instructions may be provided to initiate the jockey pump based on the pressure value associated with the output being below the first value and above a second value.

The jockey pump may be configured to operate based on the instructions to maintain the water pressure in the fire protection system between preset limits and during times when the fire protection system is not flowing water or is in a static condition. The jockey pump is sized to replenish the fire protection system water pressure due to allowable leakage and normal drops in pressure.

The controller may be configured to receive the output from the pressure sensor in the form of an electrical signal, and then determine a magnitude of the electrical signal and associate the magnitude with a given pressure value. The controller may then compare the magnitude or the pressure value with stored threshold values for initiating the jockey pump, for example.

The instructions provided to the jockey pump may further include information that indicates a minimum run time that must expire before the jockey pump may be stopped, or may include a stop/terminate signal following a minimum run time of the jockey pump to avoid unnecessary cycling of the jockey pump.

At block 406, the method 400 providing instructions to initiate a fire pump based on the pressure value associated with the output being below a second value. The second value may be less than the first value used to trigger instructions provided to the jockey pump for initiation of the jockey pump, for example. In some examples, the fire pump can be started when the water pressure is of a value outside a range that would cause the jockey pump to start. Thus, the controller can receive one pressure signal and determine which, if any, of the fire pump and the jockey pump to start.

The instructions provided to the fire pump may further include information that indicates a minimum run time that must expire before the fire pump may be stopped, or may include a stop/terminate signal following a minimum run time of the fire pump to avoid unnecessary cycling of the fire pump.

Within examples, a start pressure of the jockey pump may be set to a level higher than the start pressure of the fire pump. Thus, when pressure slowly bleeds down, the pressure will eventually reach a level where the controller will start the jockey pump, and restore system pressure to a higher level. The jockey pump can be allowed to stop or run for some minimum time and then stop. This process may maintain the sprinkler system pressure above a level that will cause the main fire pump from being started.

The fire pump is a large pump capable of maintaining water pressure while there is water flowing to sprinkler heads that have operated. It is a large capacity pump. On the other hand, the jockey pump is a small, pressure maintenance, pump that is capable of maintaining water pressure under static conditions (e.g., fire protection system is not in use or in a closed system), where the water flow is due to leakage causing pressure to bleed down slowly. Water may leak back through the check valves in the closed system toward the suction side of the pumps. This can cause the water pressure to bleed down. Either the jockey pump or the fire pump is capable of turning on and re-building pressure in the fre protection system when no sprinkler heads have operated; however, using the method 400, the jockey pump is configured to be operated for such purposes.

At block 406, a low pressure signal to the fire pump is interpreted to indicate that a sprinkler head has opened and fire extinguishing water flow and pressure is needed. Starting the fire pump can require considerable electrical (or engine) power, may cause wear to an expensive piece of equipment, and can cause a fire alarm signal to be actuated within the facility (causing evacuation) and to the fire department (causing an emergency response). Thus, actuation of the fire pump is needed when there is a pressure drop due to sprinkler heads operating or fire hose operation. Actuation of the fire pump is not desired when the fire protection system is in a static condition, or is still a closed system when the sprinklers have not operated, but the water pressure drop is due to leakage.

Within examples, the jockey pump can be configured to start at times when a water pressure drops to a first set point that is higher than a set point at which the fire pump is configured to start. The jockey pump is intended to increase water pressure until the water pressure reaches a shutoff set point (and possibly run longer due to a time delay). The shutoff can be used to prevent the jockey pump from continuously running. Once the water pressure is at a high enough "buffer" level, the jockey pump can shut off, and it can be expected that hours or days may pass before the jockey pump is needed again to maintain water pressure in the closed fire protection system.

If a sprinkler head operates, the water pressure will drop, and the fire protection system is now considered in use. The water pressure will drop until to a level that triggers starting the jockey pump, however, the jockey pump does not have capacity to keep up with the flow needed by open sprinkler heads, and so the water pressure will continue to drop to the level that will start the fire pump. The fire pump will keep up pressure even with a high flow rate needed to operate the sprinkler system.

A shutoff pressure may not be used for a fire pump. The fire protection system may be configured to require manual shut down of the fire pump, such as by a fire protection agency after it is deemed that the sprinklers are no longer needed.

In some examples, a sequence of operation of the fire protection system may be as follows:

TABLE 1

| | |
|---|---|
| 1. | Sprinkler opens due to fire being detected |
| 2. | Water pressure drops |
| 3. | Jockey pump is started |
| 4. | Pressure continues to drop because the jockey pump cannot supply enough water flow to maintain water pressure in the fire protection system |
| 5. | Fire pump starts and supplies a quantity of water at required pressure (maybe high enough to reach the stop pressure for the Jockey Pump) |
| 6. | Pressure rises, water flows, and the fire is extinguished |
| 7. | Fire is extinguished and the fire pump is manually shut off, or automatically shuts off at some pressure and after a minimum run time limit |

In the example shown in Table 1, the fire pump is started once the water pressure in the fire protection system is at a low pressure (lower than needed to start the jockey pump) and if the fire pump is configured to stop running automatically, the fire pump stop pressure can be set at a high pressure (higher than the jockey pump stop pressure).

Within other examples of the method 400, the controller may compare the output from the pressure sensor to predetermined pressure thresholds for selectively starting or stopping both the fire pump and the jockey pump. The controller may further determine time delays, set-points, or other operating parameters of both the fire pump and the jockey pump.

The controller may be configured to provide the instructions to initiate either jockey pump or the fire pump when the output from the pressure sensor is below the first value or below the second value, as described above. In other examples, the controller may be configured to determine a difference between the pressure and a threshold, and may provide the instructions when the difference is at least a predetermined amount. For instance, if the pressure difference is not greater than (i.e., less than or equal to) some amount, then the pumps may not need to be initiated. However, if the difference is large, then the pressure in the system may be low enough to require one of the pumps to be started.

In some instances, the fire pump controller may start an on-delay timer when the pressure is below threshold levels and wait a predetermined time before starting the jockey pump or fire pump to avoid starting either pump in cases of minor pressure changes or fluctuations (e.g., a pressure may be subsequently determined that is above the threshold level prior to expiration of the on-delay timer and the pumps may not be started).

Additionally, if either of the jockey pump or the fire pump is started, the fire pump controller may monitor the pressure to determine whether the pressure has been increased above the threshold level by the pumps, indicating that the pumps may be stopped.

Thus, using the method 400, the controller may receive outputs of the pressure sensor and, determine whether the pressure in the fire protection system is too low, and if so, determine which of the jockey pump or fire pump needs to be started.

The method 400 may further include, based on the controller providing instructions to initiate the fire pump, the controller further provides an alarm that the fire pump was initiated. The alarm may include notifying the fire department, for example.

The method 400 may also further include storing outputs from the pressure sensor in a memory of the fire pump controller. In one example, if one or more outputs are not received at a predetermined interval, a pressure value of zero may be assumed and used as a placeholder for the remainder of the method 400.

Figure 6:
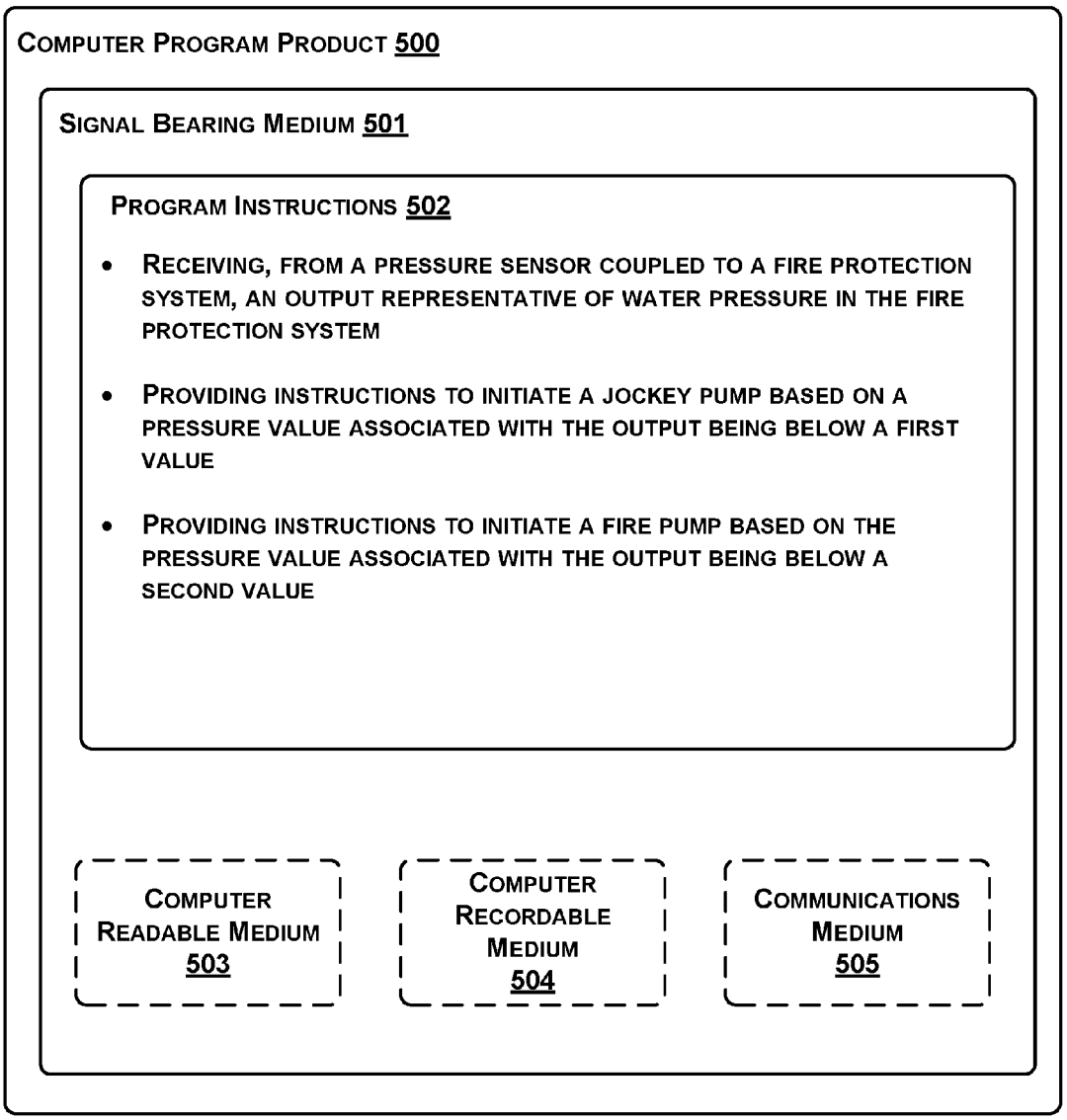
FIG. 6 is a schematic illustrating a conceptual partial view of an example computer program product that includes a computer program for executing a computer process on a computing device, arranged according to at least some embodiments presented herein.

In some embodiments, the disclosed methods may be implemented as computer program instructions encoded on a non-transitory computer-readable storage media in a machine-readable format, or on other non-transitory media or articles of manufacture. FIG. 6 is a schematic illustrating a conceptual partial view of an example computer program product 500 that includes a computer program for executing a computer process on a computing device, arranged according to at least some embodiments presented herein.

In one embodiment, the example computer program product 500 is provided using a signal bearing medium 501. The signal bearing medium 501 may include one or more programming instructions 502 that, when executed by one or more processors may provide functionality or portions of the functionality described above with respect to FIGS. 2-5. In some examples, the signal bearing medium 501 may encompass a computer-readable medium 503, such as, but not limited to, a hard disk drive, a Compact Disc (CD), a Digital Video Disk (DVD), a digital tape, memory, etc. In some implementations, the signal bearing medium 501 may encompass a computer recordable medium 504, such as, but not limited to, memory, read/write (R/W) CDs, R/W DVDs, etc. In some implementations, the signal bearing medium 501 may encompass a communications medium 505, such as, but not limited to, a digital and/or an analog communication medium (e.g., a fiber optic cable, a waveguide, a wired communications link, a wireless communication link, etc.). Thus, for example, the signal bearing medium 501 may be conveyed by a wireless form of the communications medium 505 (e.g., a wireless communications medium conforming with the IEEE 802.11 standard or other transmission protocol).

The one or more programming instructions 502 may be, for example, computer executable and/or logic implemented instructions. In some examples, a computing device such as components of FIG. 4 may be configured to provide various operations, functions, or actions in response to the programming instructions 502 conveyed to the fire pump controller by one or more of the computer readable medium 503, the computer recordable medium 504, and/or the communications medium 505.

It should be understood that arrangements described herein are for purposes of example only. As such, those skilled in the art will appreciate that other arrangements and other elements (e.g. machines, interfaces, functions, orders, and groupings of functions, etc.) can be used instead, and some elements may be omitted altogether according to the desired results. Further, many of the elements that are described are functional entities that may be implemented as discrete or distributed components or in conjunction with other components, in any suitable combination and location.

While various aspects and embodiments have been disclosed herein, other aspects and embodiments will be apparent to those skilled in the art. The various aspects and embodiments disclosed herein are for purposes of illustration and are not intended to be limiting, with the true scope being indicated by the following claims, along with the full scope of equivalents to which such claims are entitled. It is also to be understood that the terminology used herein is for the purpose of describing particular embodiments only, and is not intended to be limiting.

What is claimed is:

1. A method performed by a controller that is configured to control operation of both a fire pump and a jockey pump in a fire protection system, the method comprising:

sensing, using a pressure sensor, a water pressure in a sensing line located between (i) an input to a fire protection system and (ii) a first check valve and a second check valve, wherein the first check valve is between an outlet of a fire pump and the fire protection system, wherein the second check valve is between an outlet of a jockey pump and the fire protection system;

receiving, from the pressure sensor coupled to the fire protection system, an output representative of the sensed water pressure in the fire protection system;

providing instructions to initiate the jockey pump based on a pressure value associated with the output being below a first value, wherein the jockey pump is configured to provide a first level of water pressure in the fire protection system; and providing instructions to initiate the fire pump based on the pressure value associated with the output being below a second value, wherein the second value is less than the first value, wherein the fire pump is coupled in parallel with the jockey pump, wherein the pressure sensor is a single pressure sensor, and wherein the controller is a single controller.

2. The method of claim 1, wherein the output from the pressure sensor includes an electrical signal, and the method further comprises:

determining a magnitude of the electrical signal from the pressure sensor; and associating the magnitude with a given pressure value.

3. The method of claim 1, further comprising comparing the output from the pressure sensor to predetermined pressure thresholds for selectively starting or stopping both the fire pump and the jockey pump.

4. The method of claim 1, wherein providing the instructions to initiate the jockey pump and providing the instructions to initiate the fire pump comprises using a wired or wireless connection between the controller and the fire pump and between the controller and the jockey pump.

5. The method of claim 1, further comprising providing the instructions to initiate the jockey pump based on the pressure value associated with the output being below the first value and above the second value.

6. The method of claim 1, wherein the fire pump is configured to provide a second level of water pressure in the fire protection system that is greater than the first level of water pressure.

7. The method of claim 6, wherein the second level of water pressure is approximately five pounds per square inch (PSI) to approximately ten PSI greater than the first level of water pressure.

8. The method of claim 1, further comprising, responsive to providing instructions to initiate the fire pump, providing, to an alarm system, an alarm signal to indicate that the fire pump was initiated.

9. The method of claim 8, wherein providing the alarm signal comprises providing an audible alarm.

10. The method of claim 1, wherein the single controller includes the pressure sensor.

11. The method of claim 10, wherein the single controller comprises an enclosure housing an electronic circuit board having a microprocessor and the pressure sensor.

12. The method of claim 1, wherein providing instructions to initiate a jockey pump is performed while a plurality of sprinklers of the fire protection system are not being operated.

13. The method of claim 1, further comprising:

after providing instructions to initiate a jockey pump, determining, based on the output received from the pressure sensor, that the water pressure has reached a third level of water pressure; and responsive to determining that the water pressure has reached the third level of water pressure, providing instructions to the jockey pump to stop operation of the jockey pump, wherein the third level of water pressure is greater than the first level of water pressure.

14. The method of claim 1, further comprising:

after providing instructions to initiate a jockey pump, determining, using a timer of the controller, that the jockey pump has operated for a minimum run time; and responsive to determining that the jockey pump has operated for the minimum run time, providing instructions to the jockey pump to stop operation of the jockey pump.

15. The method of claim 1, wherein receiving, from the pressure sensor coupled to the fire protection system, the output representative of water pressure in the fire protection system comprises receiving the output from the pressure sensor on a continuous basis.

* * * * *